US012108855B2

(12) United States Patent
Woodland et al.

(10) Patent No.: US 12,108,855 B2
(45) Date of Patent: Oct. 8, 2024

(54) FOIL FOR A STRAND OF KERATINIC FIBERS AND RELATED KIT AND ILLUMINATION PROCESS

(71) Applicant: L'Oreal, Paris (FR)

(72) Inventors: Frédéric Woodland, Saint Ouen (FR); Gabin Vic, Saint Ouen (FR); Fabrice Osolin, Saint Ouen (FR)

(73) Assignee: L'OREAL, Paris (FR)

( * ) Notice: Subject to any disclaimer, the term of this patent is extended or adjusted under 35 U.S.C. 154(b) by 453 days.

(21) Appl. No.: 17/611,732

(22) PCT Filed: May 19, 2020

(86) PCT No.: PCT/EP2020/063994
§ 371 (c)(1),
(2) Date: Nov. 16, 2021

(87) PCT Pub. No.: WO2020/234311
PCT Pub. Date: Nov. 26, 2020

(65) Prior Publication Data

US 2022/0232942 A1 Jul. 28, 2022

(30) Foreign Application Priority Data

May 21, 2019 (FR) ..... 19 05313

(51) Int. Cl.
*A45D 19/00* (2006.01)

(52) U.S. Cl.
CPC ..... *A45D 19/016* (2021.01); *A45D 19/0075* (2021.01); *A45D 19/0066* (2021.01); *A45D 2200/205* (2013.01); *A45D 2200/25* (2013.01)

(58) Field of Classification Search
CPC ..... A45D 19/00; A45D 19/0041; A45D 19/0066; A45D 19/012; A45D 19/016; A45D 19/018; A45D 19/0075; A45D 19/024; A45D 19/16; A45D 1/00; A45D 1/02; A45D 1/04; A45D 1/06; A45D 1/08; A45D 1/28; A45D 2/00; A45D 2/001; A45D 2/2414; A45D 2/367; A45D 2/40; A45D 6/14; A45D 20/48; A45D 20/50; A45D 7/00; A45D 7/02; A45D 7/04;

(Continued)

(56) References Cited

U.S. PATENT DOCUMENTS 4,637,411 A 1/1987 Sanders
5,535,764 A 7/1996 Abramson (Continued)

FOREIGN PATENT DOCUMENTS

EP 0122145 A2 10/1984
EP 3 453 279 A1 3/2019

(Continued)

*Primary Examiner* — Cris L. Rodriguez
*Assistant Examiner* — Karim Asqiriba
(74) *Attorney, Agent, or Firm* — POLSINELLI PC

(57) ABSTRACT

The invention relates to a foil (14) for a strand (12) of keratinic fibers including a first sheet (20) and a second sheet, the first sheet (20) being connected to the second sheet by an articulation, in particular a hinge, the first sheet (20) being movable relative to the second sheet between a closed configuration for illumination of the strand and an open configuration. The first sheet (20) is substantially at least partially transparent to the UV-visible light, and the second sheet (22) is substantially at least partially opaque to the UV-visible light.

19 Claims, 4 Drawing Sheets

(58) Field of Classification Search
CPC ..... A45D 7/045; A45D 7/06; A45D 7/065;
A45D 2200/205; A45D 2200/25
See application file for complete search history.

(56) References Cited

U.S. PATENT DOCUMENTS

| | | | |
|---|---|---|---|
| 5,816,268 | A | 10/1998 | Awaijane |
| 2018/0049276 | A1 | 2/2018 | Goddard |

FOREIGN PATENT DOCUMENTS

| | | | |
|---|---|---|---|
| GB | 2 384 425 | A | 7/2003 |
| JP | H08982 | U | 6/1996 |
| JP | 2018517750 | A | 7/2018 |
| WO | WO 2004/054527 | A1 | 7/2004 |
| WO | WO 2015/165949 | A1 | 11/2015 |
| WO | 2016205578 | A1 | 12/2016 |
| WO | WO 2017/108767 | A1 | 6/2017 |
| WO | WO 2019/166983 | A1 | 9/2019 |

FOIL FOR A STRAND OF KERATINIC FIBERS AND RELATED KIT AND ILLUMINATION PROCESS

CROSS REFERENCE TO RELATED APPLICATIONS

This application is a National Phase filing under 35 U.S.C. § 371 of PCT/EP2020/063994filed on May 19, 2020; which application in turn claims priority to Application No. 19 05313 filed in France on May 21, 2019. The entire contents of each application are hereby incorporated by reference.

The present invention relates to a foil for a strand of keratinic fibers including a first sheet and a second sheet, the first sheet being movable relative to the second sheet between a closed configuration for illumination of the strand and an open configuration.

The foil is in particular designed to be used for the treatment of hair. The treatment in particular aims to produce a discoloration of the hair under illumination, or to attach a sheath on the hair that withstands washing in order to give the hair a volume effect.

WO 2017/108767, WO 2004/054527 and WO 2007/04872 describe cosmetic sheathing compositions applicable on the hair that include photo-cross-linkable compounds.

After application of the sheathing composition on the hair, an illumination device by light-emitting diodes (LED), is passed over the strands of hair to cross-link the polymers and thus to obtain the sheathing.

Generally, the emitted light is in the UV-visible domain, at energy doses on the order of the Joule/cm$^2$.

In other cases, when photo-oxidation must be done to discolor the hair, like in WO 2015/165949, hair treated by a composition comprising a chemical oxidizing agent is subject to the application of light with light-emitting diodes. The illuminating device is generally used at higher powers, for example on the order of around one hundred Joules/cm$^2$.

Prior to the illumination step, the strands of hair on which the cosmetic composition has been applied are generally isolated from the rest of the hair and contained inside a foil. The foil keeps the sheathing or bleaching composition on the strands of hair and also prevents direct contact between the hair and the illumination device.

The aforementioned illumination devices are very effective to offer effective radiation of the strand of hair, while ensuring confinement of the light within the device.

However, they are complex to use and generally require the presence of a professional trained to handle such devices. Incorrect handling risks causing a dispersion of light outside the desired treatment zone, which results in deteriorated treatment, and/or an alteration of the hair not treated and a risk for the user.

One aim of the invention is therefore to propose a foil for a strand of keratinic fibers that makes it possible to perform treatments requiring an illumination of the strand, while greatly limiting, or even preventing the risks of dispersion of the light.

To that end, the invention relates to a foil for a strand of keratinic fibers including a first sheet and a second sheet, the first sheet being connected to the second sheet by an articulation, in particular a hinge, the first sheet being movable relative to the second sheet between a closed configuration for illumination of the strand and an open configuration, characterized in that the first sheet is substantially at least partially transparent to the UV-visible light and in that the second sheet is substantially at least partially opaque to the UV-visible light.

According to a variant, the first sheet is substantially transparent to the light, the first sheet preferably having a transmittance greater than 75% in the wavelength region from 350 nm to 500 nm, preferably from 280 nm to 700 nm. According to a variant, the second sheet is substantially opaque to the light, the second sheet preferably having a transmittance of less than 5% in the wavelength range from 350 nm to 500 nm, preferably from 280 nm to 700 nm.

The keratinic fibers also receive a maximal illumination, with a reduced loss of light. The bodily surfaces arranged below the foil are further protected.

According to a variant, the first sheet and the second sheet each comprise at least a first face and a second face opposite the first face, the first face of the first sheet being at least partially in contact with the first face of the second sheet in the closed configuration.

According to a variant, the foil has an optical scale arranged on at least one of the first or the second sheet.

The optical scale makes it possible to control the illumination received by the strand of keratinic fibers, and thus to avoid overexposure.

According to a variant, the optical scale is arranged on the second face of the second sheet.

According to a variant, the optical scale is arranged along the articulation between a first edge and a second edge of the first or the second sheet.

The reading of the optical scale by a suitable sensor is made easier.

According to a variant, the optical scale comprises a plurality of identical patterns arranged repetitively and separated from one another by a gap that is advantageously constant.

The movement of the illumination device along the foil is thus immediately and easily measurable using an optical sensor.

According to a variant, the optical scale is obtained by screen printing.

The screen printing guarantees an intense color and good opaqueness, facilitating the reading of the optical scale.

According to a variant, at least one of the first sheet or the second sheet has a free edge opposite the articulation between the two sheets, the foil further comprising a sealing means arranged along the free edge, the sealing means being able to seal the foil in the closed configuration. The sealing means can for example be made using strips of adhesive or a Velcro system.

The strands of keratinic fibers are thus kept between the sheets of the foil during the treatment of the strand by illumination.

The articulation between the two sheets can be a gluing or a welding or an adhesive or a stapling or a Velcro device or sewing. It is done along a substantially longitudinal assembly line of the foil.

The invention also relates to a kit for a strand of keratinic fibers comprising:

- at least one foil of the aforementioned type, and
- a device for illuminating at least one strand of keratinic fibers, the illumination device advantageously comprising a first branch and a second branch defining an illumination cavity, the illumination device comprising an illumination system capable of illuminating the strand.

According to one variant, the illumination device comprises an optical system capable of measuring a movement of the illumination device relative to the optical scale if the latter is present.

According to one variant, the optical system comprises an optical sensor capable of measuring a movement of the illumination device relative to the optical scale if the latter is present, the optical system being able to control the illumination produced by the illumination system as a function of the movement of the illumination device relative to the optical scale measured by the sensor.

According to a variant, the kit further comprises a cosmetic composition for keratinic fibers able to be applied on the strand of keratinic fibers.

The invention also relates to a method for treatment of at least one strand of keratinic fibers including the following steps:

- inserting a strand between the first sheet and the second sheet of a foil of the aforementioned type, the foil being in the open configuration;
- closing the foil, the strand being between the first sheet and the second sheet;
- arranging the foil in the closed configuration such that the first sheet is located opposite an illumination system of an illumination device,
- activating the illumination system in order to illuminate the strand; and
- performing a relative movement of the illumination device with respect to the foil.

According to a variant, the illumination device has an optical sensor arranged so as to measure the movement of the illumination device with respect to an optical scale arranged on at least one of the first sheet or the second sheet of the foil.

According to a variant, the optical sensor measures the movement of the illumination device relative to the optical scale, the sensor advantageously controlling the illumination system as a function of said movement.

According to a variant, the method comprises, prior to the closing of the foil, or the insertion of the strand into the foil, a step for applying at least one cosmetic composition on the strand.

In a variant of this method, the strand is treated beforehand with at least one cosmetic composition.

According to a variant, the cosmetic composition comprises at least one chemical oxidizing agent.

Preferably, the chemical oxidizing agent is hydrogen peroxide alone or in combination with at least one persalt, and in particular at least one persulfate.

Preferably, the composition comprising at least one chemical oxidizing agent comprises at least one alkaline agent. The alkaline agent(s) can be mineral or organic.

According to a variant, the cosmetic composition comprises at least one photo-cross-linkable compound, still more preferably a photodimerizable compound.

Preferably, the photo-cross-linkable compound is a polymer. Still more preferably, the photo-cross-linkable polymer is a hydrophobized or non-hydrophobized PVA-SBQ.

The cosmetic composition comprising the chemical oxidizing agent(s) and/or the photo-cross-linkable compound(s) can also comprise at least one compound chosen from among solvents, fatty bodies that may or may not be siliconized, anionic, cationic, non-ionic or amphoteric surfactants, which may or may not be siliconized, non-photo-cross-linkable polymers, and in particular anionic, cationic, non-ionic or amphoteric treating, fixing or thickening polymers, synthetic or natural soluble coloring agents, pigments, agents breaking disulfide bonds, oxidizing agents, and anti-dandruff agents, loss prevention agents.

The composition applied on the hair in the inventive methods can result from mixing during the use of at least two compositions. This is in particular the case for bleaching, where the cosmetic composition applied on the hair preferably results from mixing at the time of the use of two compositions, one of which contains hydrogen peroxide or a hydrogen peroxide precursor, the second composition containing at least one alkaline agent. Still more preferably, the first composition is aqueous and contains hydrogen peroxide, and the second composition is anhydrous.

The keratinic fibers are preferably human hair or extensions.

According to a variant, the method comprises a step for sealing the foil in the closed configuration prior to the insertion of the foil between the first and second branches of the illumination device.

According to a variant, the method comprises a step for sealing the foil in the closed configuration prior to arranging the foil in the closed configuration opposite the illumination system.

The invention will be better understood upon reading the following description, provided solely as an example, and in reference to the appended drawings, in which.

Figure 1:
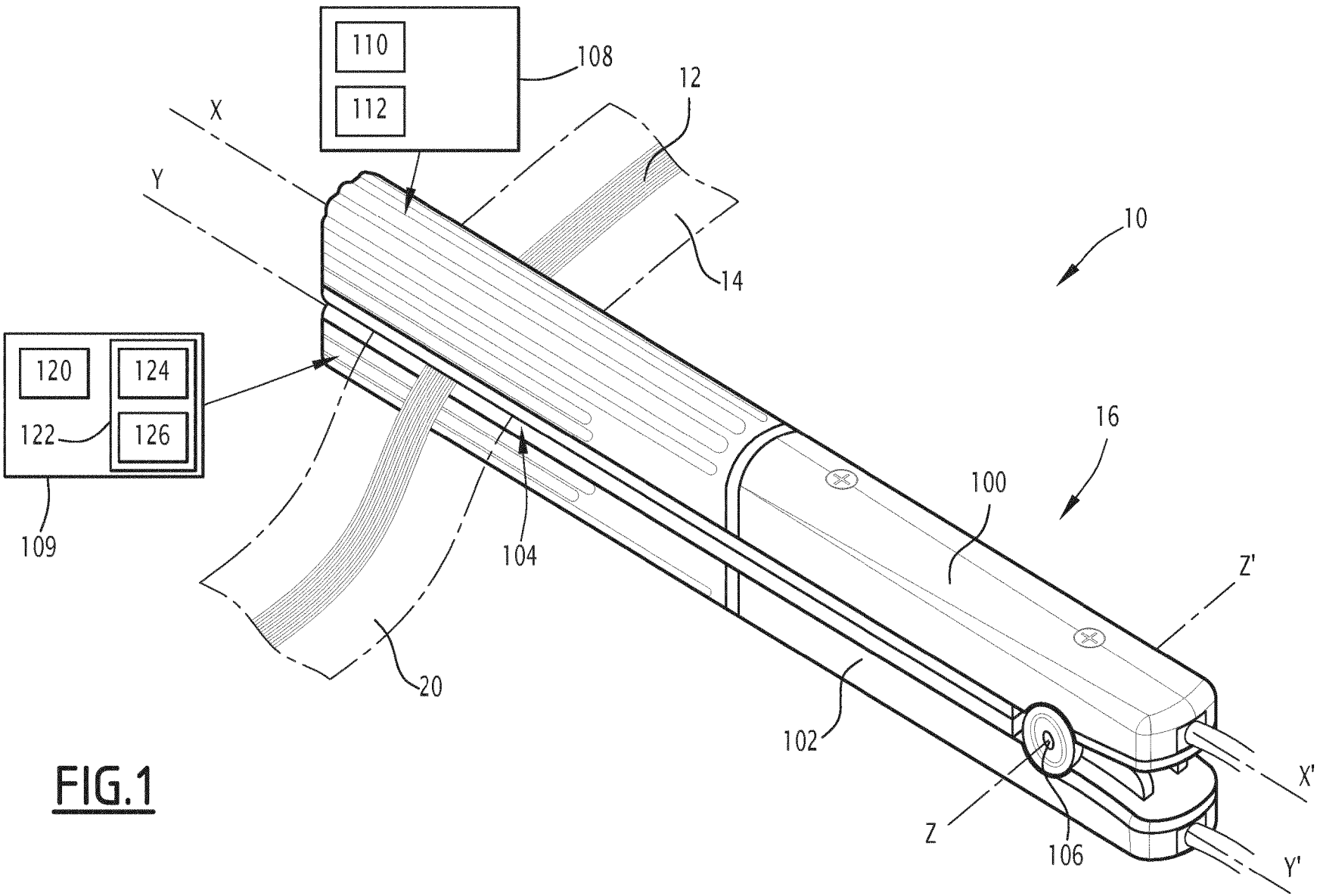
FIG. 1 is a three-quarters perspective front view of a kit according to the invention during the illumination of the strand of hair, the kit comprising an illumination device and a foil inside which the strand of hair is inserted.

A kit 10 for a strand of keratinic fibers according to the invention is shown in FIG. 1.

The kit 10 is designed to illuminate at least one strand 12 of keratinic fibers, for example previously treated by a cosmetic composition. Preferably, the keratinic fibers are hair.

In a variant, the cosmetic composition contains at least one photo-cross-linkable polymer that cross-links during the treatment by illumination of the strand 12 by the kit 10.

In a variant, the kit 10 is designed to illuminate the strand 12 of keratinic fibers to bleach the strand 12, which can be previously treated by a composition containing at least one oxidizing agent.

In reference to FIG. 1, the kit 10 includes a foil 14 and an illumination device 16 for at least one strand 12 of keratinic fibers. Advantageously, the kit 10 also includes a cosmetic product for keratinic fibers able to be applied on the strand 12 of keratinic fibers.

Figure 2:
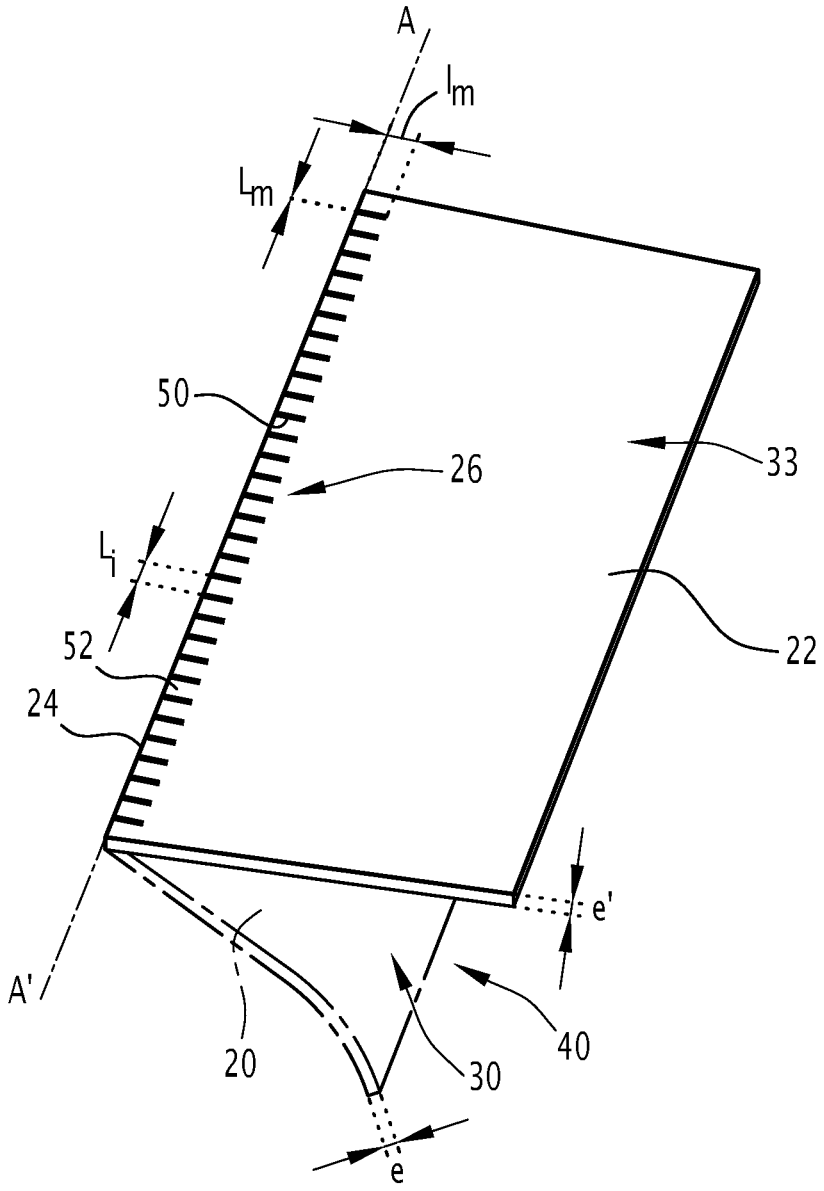
FIG. 2 is a schematic perspective view of the foil of FIG. 1.
Figure 3:
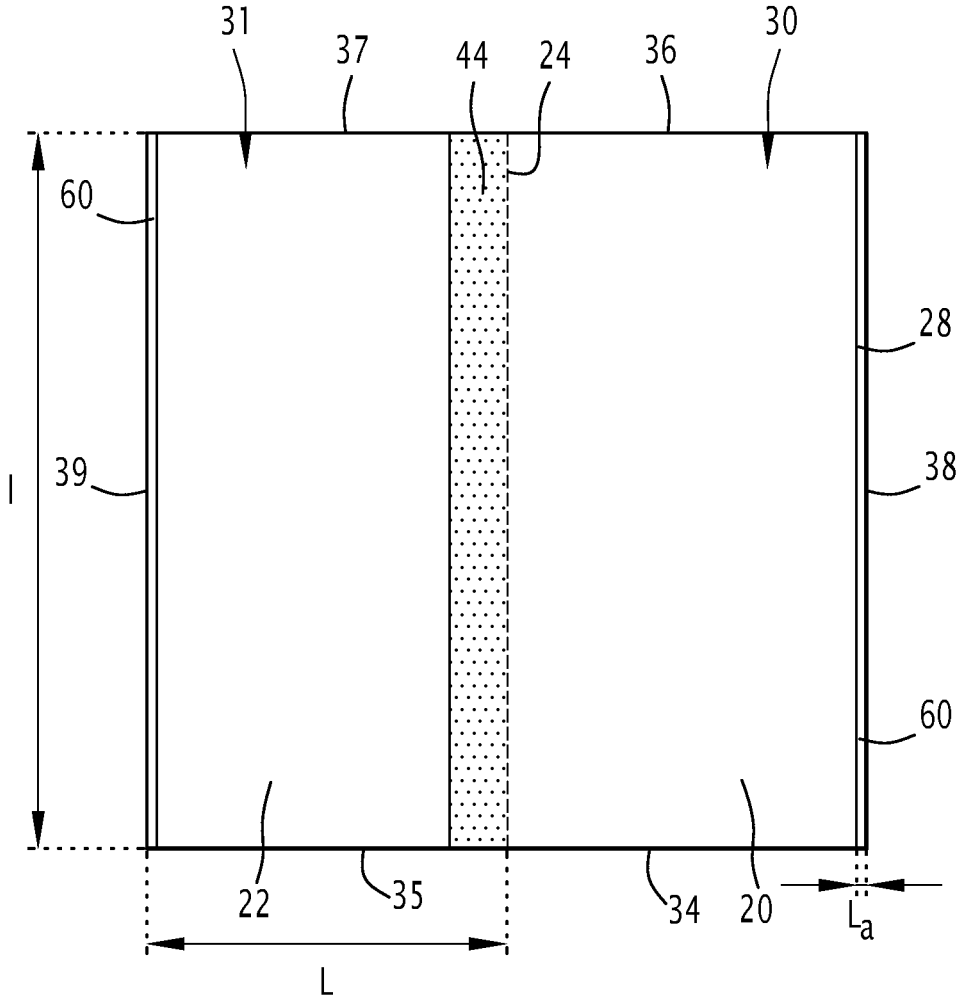
FIG. 3 is a schematic view of a first face of the foil of FIG. 2.
Figure 4:
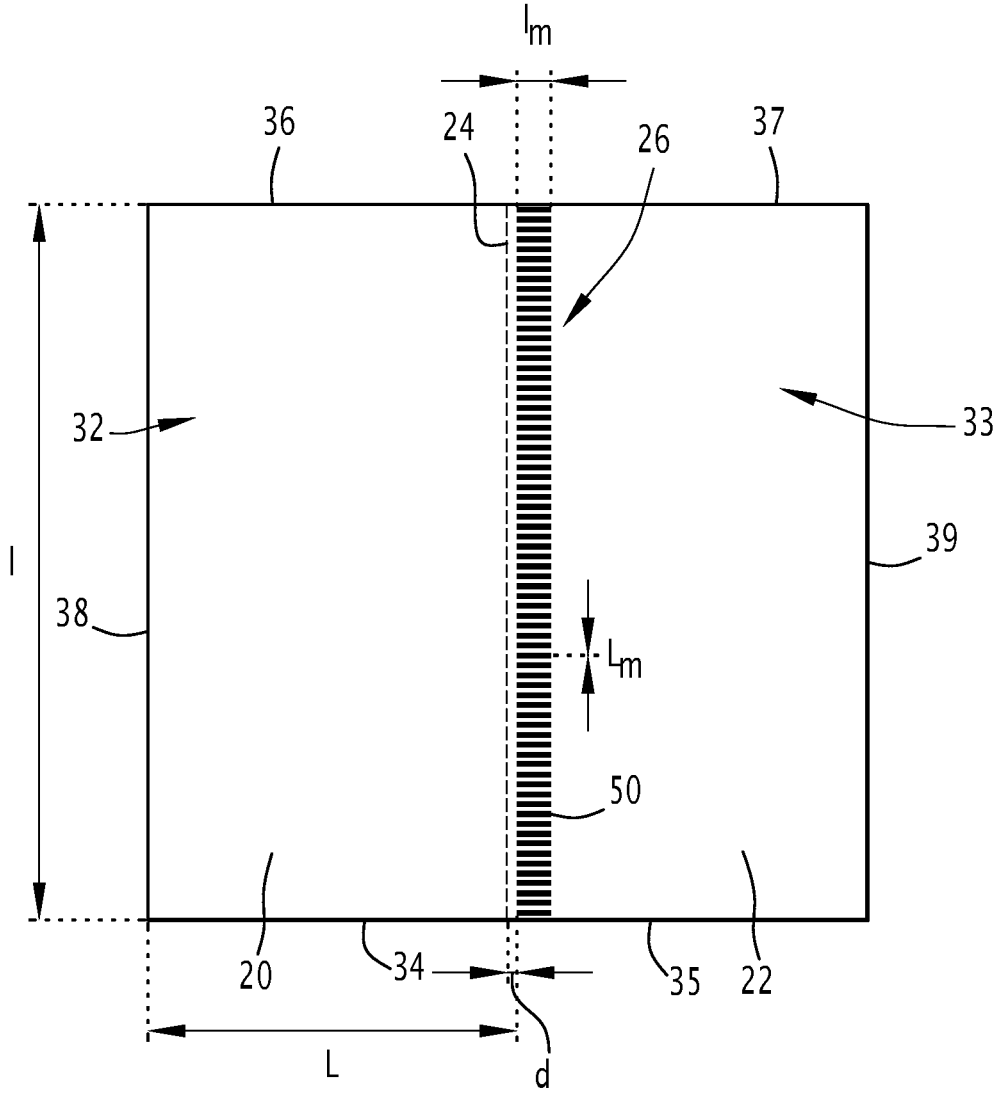
FIG. 4 is a schematic view of a second face of the foil of FIG. 2.

In reference to FIGS. 2 to 4, the foil 14 includes a first sheet 20 and a second sheet 22, the first sheet 20 being connected to the second sheet 22 by means of an articulation 24, or assembly means 24, which is for example a gluing or a welding or an adhesive or a stapling or a Velcro device or sewing. The articulation 24 is done along an assembly line. For example, the articulation 24 is a hinge.

According to one particular embodiment, the foil 14 further has an optical scale 26 arranged on at least one of the first or the second sheet 20, 22.

Advantageously, the foil 14 also comprises a sealing means 28 able to seal the foil 14 in the closed configuration.

The first and second sheets 20, 22 are able to assume any shape and any dimensions appropriate for the application of a cosmetic product on a strand of hair. In the example illustrated in FIGS. 1 to 4, the first and second sheets 20, 22 are rectangular.

In FIGS. 2 to 4, the first sheet and the second sheet 20, 22 each have a respective first face 30, 31 and second face 32, 33, the second face 32, 33 being opposite the corresponding first face 30, 31. In the example illustrated in FIGS. 2 to 4, the first faces 30, 31 are intended to be in contact with the strand 12 of hair during the illumination of the strand 12 by the illumination device 16.

In a variant, the first sheet 20 extends substantially along a longitudinal axis A-A', between a first edge 34 and a second edge 36, and substantially along a first transverse axis normal to the longitudinal axis A-A', between a free edge 38 and the articulation 24.

The second sheet 22 extends substantially along the longitudinal axis A-A', between a first edge 35 and a second edge 37, and substantially along a second transverse axis normal to the longitudinal axis A-A', between a free edge 39 and the articulation 24.

Preferably, the articulation 24 extends substantially parallel to the longitudinal axis A-A'.

In FIGS. 1 to 4, the first sheet 20 and the second sheet 22 have the same longitudinal and transverse dimensions.

The first sheet 20 and the second sheet 22 each have a length l of between 100 mm and 600 mm, preferably between 120 mm and 450 mm, the length l being measured between the first respective edge 34, 35 and the second respective edge 36, 37.

The first sheet 20 and the second sheet 22 each have a width L of between 60 mm and 200 mm, preferably between 80 mm and 150 mm, the width L being measured between the respective free edge 38, 39 and the articulation 24.

In another variant, the articulation 24 is along the smallest common dimension of the two sheets.

In a variant, the first sheet 20 has a length and/or a width different from those of the second sheet 22.

The first sheet 20 has a thickness e of between 10 μm and 100 μm, preferably between 15 μm and 50 μm, the thickness being measured between the first face 30 and the second face 32.

In FIGS. 2 to 4, the first sheet 20 is substantially at least partially transparent, preferably completely transparent, to the UV-visible light. "Substantially transparent to the light" means that the first sheet 20 has a transmittance greater than 75% in the wavelength range from 350 nm to 500 nm, preferably from 280 nm to 700 nm, the transmittance being measured via a polychromatic light source and a spectrometer, or via a monochromatic source and a photon counter. This transmittance value is determined at ambient temperature (23° C.+/−5° C.) and at atmospheric pressure (about 1013 hPa).

Preferably, the second face 32 of the first sheet 20 is texturized. "Texturized" means that said face 32 has a roughness and is not completely smooth. The roughness allows a multiple reflection of the incident light on the face 32, leading to a homogeneous diffusion of the light by the first sheet 20.

For example, the second face 32 of the first sheet 20 has a plurality of grooves extending along a main direction, the second face 32 of the first sheet then having a brushed appearance. Said main direction is for example parallel to the first transverse axis.

In a variant, the second face 32 of the first sheet 20 has a plurality of grooves extending along at least two directions, the second face 32 then having an abraded appearance. Said roughness promotes the diffusion of the light through the first sheet 20, while allowing the illumination device 16 to slide over the second face 32 of the first sheet 20.

The first sheet 20 is made from a plastic material. This plastic material is preferably thermoresistive and has a proper resistance up to at least 150° C. This means that the mechanical and optical properties of the material are not damaged at temperatures up to at least 150° C. Still more preferably, this material is a polyethylene terephthalate (designated by the acronym PET).

The second sheet 22 has a thickness e' from 10 μm to 100 μm, preferably from 15 μm to 50 μm, the thickness being measured between the first face 31 and the second face 33.

In a variant, the second face 33 of the second sheet 22 is rough. Said roughness allows the illumination device 16 to slide over the second face 33 of the second sheet 22.

The second sheet 22 is substantially at least partially opaque, preferably completely opaque, to the UV-visible light. The second sheet 22 preferably has a transmittance of less than 5% in the wavelength range from 350 nm to 500 nm, preferably from 280 nm to 700 nm, the transmittance being measured via a polychromatic light source and a spectrometer, or via a monochromatic source and a photon counter. This transmittance value is determined at ambient temperature (23° C.+/−5° C.) and at atmospheric pressure (about 1013 hPa).

The second sheet 22 is made from a material chosen from the group made up of opaque plastics (opaque polycarbonates, opaque polyethylenes, opaque polypropylenes, etc.), metals such as aluminums, and paper.

The sheets 20, 22 can be made up of several layers of different materials as long as the transmittance conditions are respected.

Thus, according to one specific embodiment, the second sheet 22 is a sheet of aluminum or paper covered with a plastic coating that ensures better stiffness while maintaining the flexibility. Also preferably, at least one of the first sheet 20 and the second sheet 22 includes at least one liquid-tight layer able to keep a cosmetic product applied on the sheet 20, 22 without the product impregnating or passing through the sheet 20, 22.

Advantageously, each of the first sheet 20 and the second sheet 22 includes at least one liquid-tight layer arranged and able to keep a cosmetic product applied on the sheet 20, 22 without the product impregnating or passing through the sheet 20, 22.

It is therefore possible to apply a product on the strand 12 placed on the exposed surface of the sheet 20, 22, in this example the respective first face 30, 31 of each sheet 20, 22, without the product passing through the first sheet 20.

Preferably, each of the first sheet 20 and the second sheet 22 is able to withstand high temperatures, typically greater than 150° C. "Able to withstand" means that the mechanical and optical properties of the sheet 20, 22 are not damaged.

Preferably, when the first 20 and/or the second 22 sheet is made from a plastic material, said first and/or second sheet 20, 22 has a glass transition temperature above 80° C.

Each of the first sheet 20 and the second sheet 22 is preferably able to withstand the cosmetic products that may be applied on the strand 12. For example, each of the first sheet 20 and the second sheet 22 is able to withstand products comprising a bleach product, for example an oxidizing product such as hydrogen peroxide.

Each of the first sheet 20 and the second sheet 22 preferably has a tearing strength compatible with the passage of the illumination device 16.

The first and the second sheets 20, 22 have a good flexibility so as to be able to be folded easily on a strand 12 of hair using the articulation 24. Preferably, the first sheet 20 has a flexibility substantially identical to the flexibility of the second sheet 22 in order to facilitate the handling of the foil 14.

In FIGS. 1 to 4, the articulation 24 is rectilinear and extends along the longitudinal axis A-A' between the first sheet 20 and the second sheet 22, preferably over the entire length of the sheets 20, 22.

The first sheet 20 is movable relative to the second sheet 22 around the articulation 24 between a closed configuration for illumination of the strand 12 and an open configuration.

In the open configuration, the sheets 20, 22 are only in contact with one another at the articulation 24. The first two faces 30, 31 are located partially separated from one another and define a receiving area 40 designed to receive at least one strand 12 of keratinic fibers. In the open configuration, the volume of the receiving area 40, taken between the first two faces 30, 31, is large enough to allow an easy insertion of the strand 12 between the sheets 20, 22.

In the closed configuration for illumination of the strand 12, the sheets 20, 22 surrounding the strand 12 are in contact with one another at the articulation 24 and at least part of their respective first face 30, 31. The first faces 30, 31 are then located opposite one another and the first transverse axis of the first sheet 20 is substantially parallel to the second transverse axis of the second sheet 22. The volume of the receiving area 40, taken between the first two faces 30, 31, is minimal.

In FIGS. 1 to 4, the optical scale 26 is arranged on the second face 33 of the second sheet 22.

The optical scale 26 extends along the longitudinal axis A-A', between the first edge 35 and the second edge 37 of the second sheet 22.

In FIGS. 2 and 4, the optical scale 26 extends along the articulation 24. "Along the articulation 24" means that the optical scale 26 extends at a distance d from the articulation 24 of less than 10 mm, and preferably 5 mm.

Preferably, the position of the optical scale 26 is indicated on the first face 31 of the second sheet 22 using a printed zone 44 across from the optical scale 26. This indication informs the user of the foil 14 that the hair must not be located at this level, to avoid disrupting the reading by an optical sensor of the illumination device 16.

The optical scale 26 comprises a plurality of patterns 50 arranged repetitively and separated from one another by a gap 52.

The patterns 50 have a different color from that of the second face 33 of the second sheet 22.

In FIGS. 2 and 4, the patterns 50 are identical. Each pattern 50 has a rectangular shape. In a variant, the patterns 50 have a circular or elliptical shape.

Each pattern 50 has a length $l_m$ of between 3 mm and 40 mm, the length $l_m$ being measured along the second transverse axis. Each pattern 50 has a width $L_m$ of between 0.1 mm and 3 mm, the width $L_m$ being measured along the longitudinal axis A-A'.

Preferably, the gap 52 between two adjacent patterns 50 is constant and has a width $L_i$ of between 0.1 mm and 3 mm, the width $L_i$ being measured along the longitudinal axis A-A'.

For example, the optical scale 26 is obtained by screen printing. The patterns 50 are made by depositing ink on the second face 33 of the second sheet 22.

The sealing means 28 is arranged along the free edge 38, 39 of the first and/or the second sheet 20, 22. For example, the sealing means 28 is an adhesive or a Velcro system arranged along the free edge 38, 39.

In FIG. 3, each of the first and the second sheet 20, 22 has, on its first respective face 30, 31, a glued zone 60 in the form of a strip running along the respective free edge 38, 39. The glued zone 60 extends over the entire length of the free edge 38, 39 and has a width $L_a$ of between 1 mm and 10 mm. In a variant, only one of the first and the second sheet 20, 22 has, on its first respective face 30, 31, a glued zone 60.

The sealing means 28 prevents keratinic fibers from the strand 12 from leaving the foil 14 laterally when the foil 14 is in the closed illumination configuration.

Advantageously, the sealing means 28 is not permanent and the foil 14 is able to go from the closed configuration to the open configuration by ungluing the first sheet 20 and the second sheet 22.

The illumination device 16 for a lock of hair 12 according to the invention is illustrated in FIG. 1. The device 16 here is a clamp and is designed to illuminate the strand 12 of hair so as for example to illuminate a strand 12 optionally treated beforehand by a cosmetic composition, for example to bleach it.

In reference to FIG. 1, the illumination device 16 includes a first branch 100 and a second branch 102, the branches 100, 102 being mounted movably relative to one another, between an open position for introducing the foil 14 into the illumination device 16 and a closed position for confining the foil 14 in an illumination cavity 104 between the first branch 100 and the second branch 102, visible in FIG. 1.

The device 16 further includes an assembly 106 for articulating the first branch 100 with the second branch 102 and a system 108 for illuminating the strand 12 in the illumination cavity 104.

According to one specific embodiment, the device 16 further includes an optical system 109 able to measure a movement of the illumination device 16 relative to the optical scale 26.

The first branch 100 extends along a longitudinal axis X-X' and has a first inner surface delimiting a first side of the illumination cavity 104. The second branch 102 extends along a longitudinal axis Y-Y' and has a second inner surface delimiting a second side of the illumination cavity 104.

In this example, the first branch 100 and the second branch 102 are mounted movably relative to one another in rotation, by means of the articulation assembly 106 between the open position and the closed position. The rotation is done about an axis Z-Z' perpendicular to the longitudinal axis X-X', Y-Y' of each branch 100, 102.

In the open position of the illumination device 16, the first branch 100 is partially moved away from the second branch 102. The volume of the intermediate space between the branches 100, 102, taken between the first inner surface and the second inner surface, is maximal to allow an easy introduction of the foil 14 between the branches 100, 102.

In the closed position of the illumination device 16, visible in FIG. 1, the first branch 100 and the second branch 102 are brought closer to one another in order to place their longitudinal axes X-X' and Y-Y' substantially parallel to one another.

The first inner surface and the second inner surface are then located across from one another. The volume of the intermediate space between the branches 100, 102, taken between the first inner surface and the second inner surface, is then minimal.

The illumination system 108 includes at least one light source 110, and preferably at least one controller 112 of the operation of the or each light source 110.

The light source 110 is mounted on one of the first and the second branch 100, 102, on the inner surface. In FIG. 1, the light source 110 is mounted on the first branch 114.

The light source 110 is for example formed by at least one light-emitting diode, preferably by a group of light-emitting diodes.

The illumination produced by the light source 110 is preferably produced in the range of wavelengths from 280 nanometers to 700 nanometers, and preferably from 350 to 500 nm.

Advantageously, the light source 110 is able to develop a light power from 0.5 Joules/$cm^2$ to 5000 Joules/$cm^2$.

To perform these photo-cross-linking and/or treatment operations of a cosmetic composition on the strand 12, the lighting power will preferably be from 0.5 Joules/$cm^2$ to 20 Joules/$cm^2$.

During bleaching operations of the strand 12, the lighting power will preferably be from 1 Joule/$cm^2$ to 5000 Joules/$cm^2$, preferably from 50 Joules/$cm^2$ to 2000 Joules/$cm^2$, better from 100 Joules/$cm^2$ to 2000 Joules/$cm^2$, still better from 200 Joules/$cm^2$ to 1000 Joules/$cm^2$.

The optical system 109 is capable of measuring the movement of the illumination device 16 relative to the optical scale 26 and controlling the illumination produced by the illumination system 108 as a function of the movement of the illumination device 16 relative to the optical scale 26.

According to one embodiment, the optical system 109 includes an optical sensor 120.

The optical sensor 120 is arranged on one of the first and the second branch 100, 102. In FIG. 1, the optical sensor 120 is mounted on the second branch 102.

The optical sensor 120 is for example a sensor of the CCD (charge-coupled device) type, or a CMOS (complementary metal-oxide semiconductor) sensor. Advantageously, the optical sensor 120 is associated with a timing system able to measure the time.

A control module 122 can be configured to control the level of illumination produced by the illumination system 108.

For example, as a function of the data measured by the optical sensor 120, the control module 122 is configured to transmit an illumination instruction to the illumination system 108, in particular to the controller 112, the instruction being the maintenance, increase or decrease of the level of illumination, or even the elimination of the illumination.

For example, when a movement measured by the optical sensor 120 is below a minimum authorized value for a defined time, the control module 122 transmits a instruction to the illumination system 108, such that the level of illumination of the strand 12 is decreased or eliminated, in order to prevent the strand 12 from being overexposed.

Conversely, when a movement measured by the optical sensor 120 is above a maximum authorized value for a defined time, the control module 122 transmits a instruction to the illumination system 108, such that the level of illumination of the strand 12 is increased, in order to prevent the strand 12 from being underexposed.

The minimum authorized value and the maximum authorized value are potentially adjustable by the user, for example from an adjusting device arranged on one of the branches 100, 102 of the illumination device 16. These values are for example adjustable as a function of the type of hair or the selected treatment (sheathing or bleaching).

In the example of FIG. 1, the optical system 109 includes a memory 124 and a processor 126 associated with said memory 124.

The control module 122 can implement software, or a software component, executable by the processor 126. The memory 124 of the optical system 109 is then able to store software for establishing an illumination instruction and software for transmitting at least one illumination instruction to the illumination system 108, in particular to the controller 112. The processor 126 is then able to execute each of the establishing software and the transmission software.

The operation of the kit 10 for a strand 12 of keratinic fibers will now be described.

Initially, the user places the foil 14 in the open position and grasps a strand 12 of hair intended to undergo an illumination.

In the case of a photo-cross-linking treatment, the strand 12 has, prior to illumination, been coated with a cosmetic composition containing at least one photo-cross-linkable compound.

In the case of a bleaching treatment, the strand 12 has, prior to illumination, for example been coated with a cosmetic composition containing at least one oxidizing compound.

The user then inserts the strand 12 between the first sheet 20 and the second sheet 22 of the foil 14 across from the first faces 30, 31.

Then, the user transitions the foil 14 to its closed illumination position by bringing the first sheet 20 and the second sheet 22 closer to one another.

When the foil 14 includes a sealing means 28, the latter is implemented in order to prevent the keratinic fibers of the strand 12 from leaving the receiving area 40 during the passage of the illumination device 16.

Then, the user places the illumination device 16 in the open position and inserts the foil 14 between the first branch 100 and the second branch 102 in the illumination cavity 104, such that the first sheet 20 is located opposite the light source(s).

The optical scale 26, if it is present, is placed opposite the optical system 109, such that the optical system 109 is able to measure the movement of the illumination device 16 relative to the optical scale 26.

Then, the user transitions the illumination device 16 to its closed position by bringing the first branch 100 and the second branch 102 closer to one another. During this approach, the inner surface of the first branch 100 is placed across from the inner surface of the second branch 102 to close the illumination cavity 104.

The user then activates the light source 110. The controller 112 controls the light source 110 to apply the desired illumination on the strand 12.

Then, the user moves the illumination device 16 along the foil 14 in order to treat the strand 12 over a chosen length.

The optical system 109, when it is present, uses the optical sensor 120 to measure the movement of the illumination device 16 relative to the optical scale 26.

The control module 122 then controls the level of illumination produced by the illumination system 108.

When the movement measured by the optical sensor 120 is between the maximum authorized value and the minimum authorized value for a defined time, the control module 122, in particular the processor 126, sends a maintenance instruction of the level of illumination to the controller 112.

When the movement measured by the optical sensor 120 is above the maximum authorized value, that is to say, when the user passes the illumination device 16 over the foil 14 too quickly, the control module 122, in particular the processor 126, transmits an instruction to increase the level of illumination to the controller 112. Said controller 112 then increases the illumination power of the light source 110. It is therefore not necessary to perform several passes of the illumination device 16 along the foil 14 in order to obtain the desired illumination.

When the movement measured by the optical sensor 120 is below the minimum authorized value, that is to say, when the user passes the illumination device 16 over the foil 14 too slowly, the control module 122, in particular the processor 126, transmits an instruction to decrease the level of illumination to the controller 112. Said controller 112 then decreases the illumination power of the light source 110 in order to avoid overexposing the strand 12.

A regular illumination level of the strand 12 is thus maintained during the passage of the illumination device 16 over the foil 14, independently of the passage speed of the illumination device 16 relative to the strand 14.

Then, the user opens the illumination device 16 again in order to remove the strand 14.

Optionally, the user places another foil 14 between the branches 100, 102 or uses the same foil 14 with a different strand 12.

The kit 10 according to the invention is thus easy to use.

Even in the case of incorrect use, for example by a passage of the illumination device 16 too fast or too slow, the level of illumination experienced by the strand 12 is constant along the strand 12, ensuring an optimal treatment of the keratinic fibers.

The foil 14 according to the invention limits the risk of light leaking outside the desired treatment zone, which can result in deteriorated treatment, and/or an alteration of the hair not treated and/or a risk for the user.

When the foil 14 has an optical scale 26, the foil 14 according to the invention limits, when it is used with the illumination device 16, the risk of the keratinic fibers of the strand 12 being overexposed during the illumination, which would cause them to be altered, or conversely the risk of them being underexposed with an insufficient technical result, which would then potentially require several passes of the illumination device 16, with a risk of not controlling the total illumination received by the strand 12.

In a variant, the sheets 20, 22 each have a non-rectangular shape, for example with a circular, oval or elliptical contour, as long as they have dimensions making it possible to apply a product on a strand of hair ergonomically.

In a variant, the patterns of the optical scale are not all identical. For example, the patterns have a length increasing between the first edge 35 and the second edge 37. This allows the illumination device 16 to know its location relative to the foil 14 along the longitudinal axis A-A', and optionally to adapt the level of illumination of the strand as a function of this location, for example to produce shading effects along the strand 12.

In a variant, not shown, the foil 14 has no articulation between the first sheet 20 and the second sheet 22. Only the differences with respect to the foil 14 comprising an articulation as described above will be described in detail below.

In this variant, the first sheet 20 extends substantially along a first longitudinal axis, between a first edge and a second edge, and substantially along a first transverse axis normal to the first longitudinal axis, between a first free edge and a second free edge. The second sheet 22 extends substantially along a second longitudinal axis, between a first edge and a second edge, and substantially along a second transverse axis normal to the second longitudinal axis, between a first free edge and a second free edge.

The widths of the first sheet 20 and the second sheet 22 are then measured between the first respective free edge and the second respective free edge.

The first sheet 20 is movable relative to the second sheet 22 between a closed configuration for illumination of the strand 12 and an open configuration.

In the open configuration, the first two faces 30, 31 are located separated from one another and define a receiving area 40 designed to receive at least one strand 12 of keratinic fibers. In the open configuration, the volume of the receiving area 40, taken between the first two faces 30, 31, is large enough to allow an easy insertion of the strand 12 between the sheets 20, 22.

In the closed configuration for illumination of the strand 12, the sheets 20, 22 surrounding the strand 12 are in contact with one another on at least part of their respective first face 30, 31. The first faces 30, 31 are then located across from one another. The first longitudinal axis of the first sheet 20 is then substantially parallel to the second longitudinal axis of the second sheet 22 and the first transverse axis of the first sheet 20 is substantially parallel to the second transverse axis of the second sheet 22. The volume of the receiving area 40, taken between the first two faces 30, 31, is minimal.

In this embodiment, the optical scale 26 extends along a free edge. "Along the free edge" means that the optical scale 26 extends at a distance d from said free edge of less than 10 mm, and preferable 5 mm.

The invention claimed is:

1. A kit for a strand of keratinic fibers, comprising:

at least one foil for a strand of keratinic fibers including a first sheet and a second sheet, the first sheet being movable relative to the second sheet between a closed configuration for illumination of the strand and an open configuration, the first sheet being substantially at least partially transparent to the UV-visible light and the second sheet being substantially at least partially opaque to the UV-visible light, and a device for illuminating at least one strand of keratinic fibers, the illumination device advantageously comprising a first branch and a second branch defining an illumination cavity, the illumination device comprising an illumination system capable of illuminating the strand, the at least one foil having an optical scale arranged on at least one of the first sheet or the second sheet, the illumination device comprising an optical system able to measure a movement of the illumination device relative to the optical scale.

2. The kit according to claim 1, wherein the first sheet has a transmittance greater than 75% in the wavelength range from 350 nm to 500 nm.

3. The kit according to claim 1, wherein the second sheet has a transmittance of less than 5% in the wavelength range from 350 nm to 500 nm.

4. The kit according to claim 1, wherein the first and the second sheets each comprise at least a first face and a second face opposite the first face, the first face of the first sheet being at least partially in contact with the first face of the second sheet in the closed configuration, the optical scale being arranged on the second face of the second sheet.

5. The kit according to claim 1, wherein the optical scale comprises a plurality of identical patterns arranged repetitively and separated from one another by a gap that is advantageously constant.

6. The kit according to claim 1, wherein the optical scale is obtained by screen printing.

7. The kit according to claim 1, wherein the first sheet is connected to the second sheet by means of an articulation.

8. The kit according to claim 7, the at least one foil having an optical scale arranged on at least one of the first sheet or the second sheet, wherein the optical scale is arranged along the articulation between a first edge and a second edge of the first or the second sheet.

9. The kit according to claim 7, wherein at least one of the first sheet or the second sheet has a free edge opposite the articulation, the at least one foil further comprising a sealing means arranged along the free edge, the sealing means being able to seal the at least one foil in the closed configuration.

10. The kit according to claim 1, wherein the at least one foil is devoid of articulation between the first sheet and the second sheet.

11. The kit according to claim 1, wherein the optical system comprises an optical sensor, the optical system being capable of controlling the illumination produced by the illumination system as a function of the movement of the illumination device relative to the optical scale measured by the sensor.

12. The kit according to claim 1, further comprising at least one cosmetic composition for keratinic fibers able to be applied on the strand of keratinic fibers.

13. A method for treating at least one strand of keratinic fibers including :

inserting the strand between the first sheet and the second sheet of the at least one foil of the kit according to claim 1, the at least one foil being in the open configuration;

closing the at least one foil, the strand being between the first and the second sheets;

arranging the at least one foil in the closed configuration such that the first sheet is located opposite the illumination system of the illumination device, activating the illumination system in order to illuminate the strand; and performing a relative movement of the illumination device with respect to the at least one foil.

14. The method according to claim 13, wherein the illumination device has an optical sensor arranged so as to measure the movement of the illumination device with respect to the optical scale arranged on at least one of the first sheet or the second sheet of the at least one foil.

15. The method according to claim 14, wherein the optical sensor measures the movement of the illumination device relative to the optical scale, the sensor advantageously controlling the illumination system as a function of said movement.

16. The method according to claim 13, comprising, prior to the closing of the at least one foil, a step for applying at least one cosmetic composition on the strand.

17. The method according to claim 16, wherein the cosmetic composition contains at least one chemical oxidizing agent.

18. The method according to claim 16, wherein the cosmetic composition contains at least one photo-cross-linkable compound.

19. The method according to claim 13, comprising a step for sealing the at least one foil in the closed configuration prior to arranging the at least one foil in the closed configuration opposite the illumination system.

* * * * *